US010648681B2

(12) United States Patent
Yamamoto et al.

(10) Patent No.: US 10,648,681 B2
(45) Date of Patent: May 12, 2020

(54) HEAT SOURCE UNIT AND REFRIGERATION CYCLE APPARATUS

(71) Applicant: Mitsubishi Electric Corporation, Tokyo (JP)

(72) Inventors: Katsuyuki Yamamoto, Tokyo (JP); Seiji Nakashima, Tokyo (JP); Yohei Kato, Tokyo (JP); Tsubasa Tanda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/097,852

(22) PCT Filed: Jul. 19, 2016

(86) PCT No.: PCT/JP2016/071189
§ 371 (c)(1),
(2) Date: Oct. 31, 2018

(87) PCT Pub. No.: WO2018/016012
PCT Pub. Date: Jan. 25, 2018

(65) Prior Publication Data

US 2019/0137120 A1 May 9, 2019

(51) Int. Cl.
*F24H 3/06* (2006.01)
*F24F 1/38* (2011.01)

(52) U.S. Cl.
CPC ..... *F24F 1/38* (2013.01)

(58) Field of Classification Search
CPC ..... F24F 1/38
(Continued)

(56) References Cited

U.S. PATENT DOCUMENTS

2006/0177304 A1* 8/2006 Omori ..... F04D 29/30 415/206
2011/0017427 A1* 1/2011 Kato ..... F04D 29/164 165/59

(Continued)

FOREIGN PATENT DOCUMENTS

JP H08-210665 A 8/1996
JP H11-005252 A 1/1999

(Continued)

OTHER PUBLICATIONS

International Search Report of the International Searching Authority dated Oct. 18, 2016 for the corresponding international application No. PCT/JP2016/071189 (and English translation).

(Continued)

*Primary Examiner* — Claire E Rojohn, III
(74) *Attorney, Agent, or Firm* — Posz Law Group, PLC

(57) ABSTRACT

A bellmouth of a heat source unit includes: a straight tubular portion having a cylindrical shape; an air inlet portion which is radially expanded toward the upstream side, wherein, the air inlet portion has at least one angle-reduced portion that satisfies θ0>θi>0, where, an angle formed by a line L1 and a line L2 is taken as θ0, and an angle formed by a straight line L3 and the line L2 is taken as θi, the line L1 is a line passing through a portion of an outer peripheral end portion of the air inlet portion, the line L2 is a line passing through a connecting portion between the air inlet portion and the straight tubular portion, and the straight line L3 is a line connecting an intersection P of the line L1 and the line L2 and a portion of the outer peripheral end portion of the air inlet portion.

6 Claims, 6 Drawing Sheets

(58) Field of Classification Search
USPC ..... 165/122
See application file for complete search history.

(56) References Cited

U.S. PATENT DOCUMENTS

| | | | | |
|---|---|---|---|---|
| 2011/0127019 | A1 | 6/2011 | Abastari et al. | |
| 2011/0255239 | A1* | 10/2011 | Franz | F04D 29/522 361/679.48 |
| 2011/0275302 | A1* | 11/2011 | Tarada | A62C 3/0221 454/166 |
| 2012/0328420 | A1* | 12/2012 | Ikeda | F04D 29/281 415/177 |
| 2013/0125579 | A1* | 5/2013 | Okazawa | F24F 1/38 62/507 |
| 2015/0168008 | A1* | 6/2015 | Sakoda | F24F 1/0029 165/121 |
| 2016/0348699 | A1* | 12/2016 | Arai | F04D 19/002 |
| 2017/0234572 | A1* | 8/2017 | Harris | F24F 13/0254 454/248 |
| 2019/0107297 | A1* | 4/2019 | Koike | F24F 1/50 |

FOREIGN PATENT DOCUMENTS

| | | | |
|---|---|---|---|
| JP | 2004-150654 | A | 5/2004 |
| JP | 2011-111998 | A | 6/2011 |
| JP | 2011-179778 | A | 9/2011 |
| JP | 2016-011612 | A | 1/2016 |
| WO | 2012/035577 | A1 | 3/2012 |
| WO | 2012/098652 | A1 | 7/2012 |

OTHER PUBLICATIONS

Office Action dated Sep. 10, 2019 issued in corresponding JP patent application No. 2018-528133 (and English tanslation).
Office Action dated Feb. 25, 2020 issued in corresponding JP patent application No. 2018-528133 (and English translation).

* cited by examiner

HEAT SOURCE UNIT AND REFRIGERATION CYCLE APPARATUS

CROSS REFERENCE TO RELATED APPLICATION

This application is a U.S. national stage application of PCT/JP2016/071189 filed on Jul. 19, 2016, the contents of which are incorporated herein by reference.

TECHNICAL FIELD

The present invention relates to a heat source unit including a fan having a bellmouth, and to a refrigeration cycle apparatus including the heat source unit.

BACKGROUND ART

For an air-conditioning apparatus as an example of a refrigeration cycle apparatus, studies have hitherto been conducted to improve air-sending performance of an outdoor unit being a heat source unit. As one of the air-conditioning apparatuses described above, for example, an air-conditioning apparatus disclosed in Patent Literature 1 is known, Patent Literature 1 discloses an outdoor unit including a fan, a heat exchanger, and a partition plate. The heat exchanger is arranged behind the fan. The partition plate is arranged in front of the fan, and is configured to separate a part closer to an air inlet and a part closer to an air outlet. The partition plate has a first orifice having a substantially cylindrical shape and a second orifice having a conical shape. The first orifice is formed so as to surround an outer periphery of a rear end portion of the fan and project to the air inlet, and has a distal end portion formed as an open end toward the air outlet. The second orifice is concentric with the first orifice to expand toward the air outlet, and is provided so as to continue to an outer side of the first orifice.

According to the configuration disclosed in Patent Literature 1, the following effects can be obtained. Specifically, when the second orifice is formed in a slope of a conical shape, or two levels of slopes of a conical shape are formed in the second orifice, release from the second orifice can be prevented for a large air volume. Further, when a portion of the slope of a conical shape has a flat surface facing the first orifice, flow of air can be smoothed to increase an air volume and reduce noise.

CITATION LIST

Patent Literature

Patent Literature 1: Japanese Unexamined Patent Application Publication No. 2011-179778

SUMMARY OF INVENTION

Technical Problem

In the outdoor unit of the air-conditioning apparatus disclosed in Patent Literature 1, however, a downstream side of a straight tubular portion that surrounds the fan is open. Therefore, flow of air that is blown off becomes turbulent. As a result, the air collides against an air outlet grille to increase noise. In addition, a bellmouth is generally formed of a metal plate. Therefore, it is difficult to form an air outlet portion in addition to the air inlet portion as disclosed in Patent Literature 1 on a single bellmouth.

The present invention has been made in view of the problems described above as a background, and an object thereof is to provide a heat source unit and a refrigeration cycle apparatus, which are improved in air-sending performance to reduce noise.

Solution to Problem

According to one embodiment of the present invention, there is provided a heat source unit, comprising: an axial-flow fan: and a bellmouth surrounding an outer periphery of the axial-flow fan, wherein the bellmouth includes: a straight tubular portion having a cylindrical shape; an air inlet portion, which is positioned on an upstream side of the straight tubular portion, and is radially expanded toward the upstream side; and an air outlet portion, which is positioned on a downstream side of the straight tubular portion, and is radially expanded toward the downstream side, and wherein, in sectional view of the air inlet portion of the bellmouth taken along a direction parallel to flow of an air, the air inlet portion has at least one angle-reduced portion that satisfies $\theta 0 > \theta i > 0$, where, an angle formed by a line L1 and a line L2 is taken as $\theta 0$, and an angle formed by a straight line L3 and the line L2 is taken as $\theta i$, the line L1 is a line passing through a portion of an outer peripheral end portion of the air inlet portion, which has a maximum diameter, and running in parallel to an axial direction of the axial-flow fan, the line L2 is a line passing through a connecting portion between the air inlet portion and the straight tubular portion and running in a direction orthogonal to the axial direction of the axial-flow fan, and the straight line L3 is a line connecting an intersection P of the line L1 and the line L2 and a portion of the outer peripheral end portion of the air inlet portion, which has a diameter smaller than the maximum diameter and larger than a minimum diameter.

According to one embodiment of the present invention, there is provided a refrigeration cycle apparatus, including: the heat source unit described above; and a load-side unit to be connected to the heat source unit.

Advantageous Effects of Invention

According to the heat source unit of one embodiment of the present invention, the angle-reduced portion is formed on at least a part of the air inlet portion of the bellmouth. Therefore, the air flowing into the casing can be made to flow along the air inlet portion. Thus, release of the air can be suppressed, and hence noise reduction can also be achieved.

The refrigeration cycle apparatus of one embodiment of the present invention includes the heat source unit described above. Therefore, the air flowing into the heat source unit can be made to flow along the air inlet portion of the bellmouth. Thus, the release of the air can be suppressed, and hence generation of the noise is reduced.

DESCRIPTION OF EMBODIMENTS

Now, embodiments of the present invention are described with reference to the drawings as appropriate. Note that, the relationships between the sizes of components in the following drawings including FIG. 1 may be different from the actual relationships. Further, in the following drawings including FIG. 1, components denoted by the same reference symbols correspond to the same or equivalent components. This is applied throughout the description. In addition, the forms of the components described herein are merely examples, and the components are not limited thereto.

Embodiment 1

Figure 1:
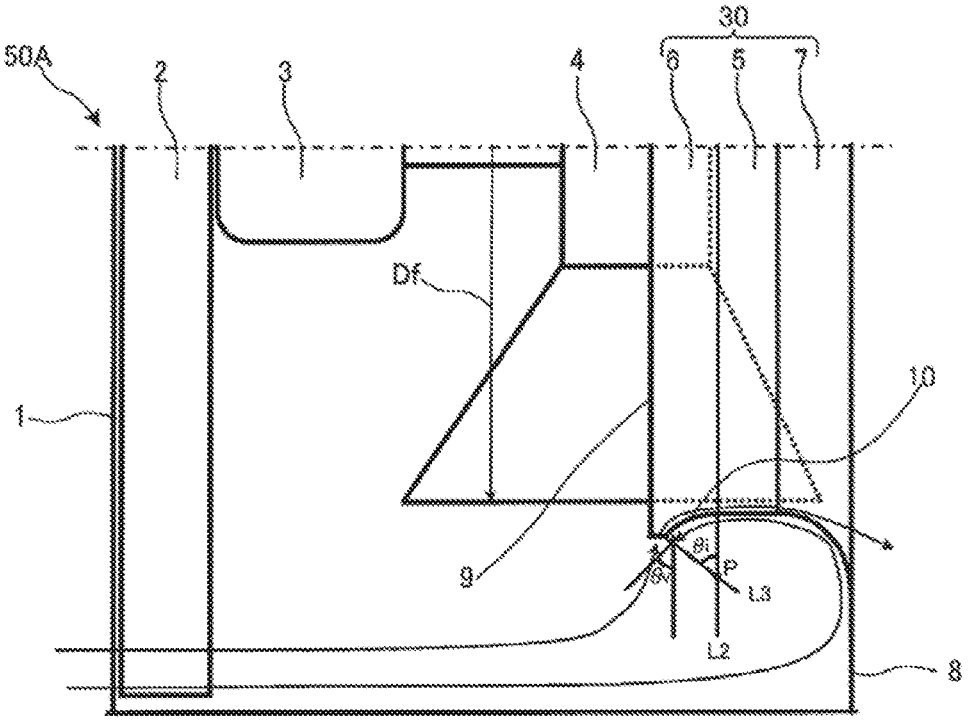
FIG. 1 is a schematic sectional view of a configuration example of a heat source unit according to Embodiment 1 of the present invention as viewed from a side.
Figure 2:
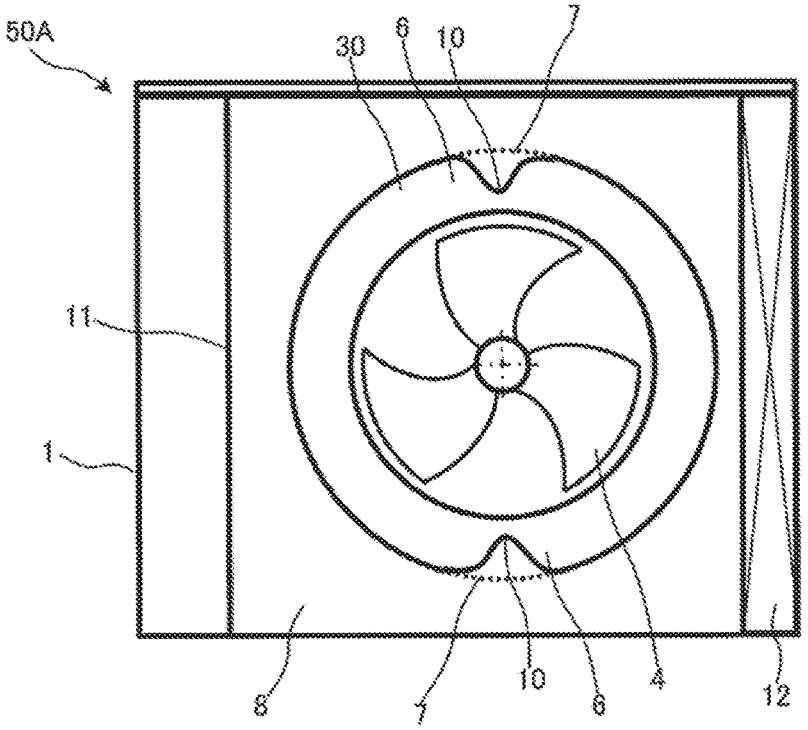
FIG. 2 is a schematic sectional view of the configuration example of the heat source unit according to Embodiment 1 of the present invention as viewed from a front side.
Figure 3:
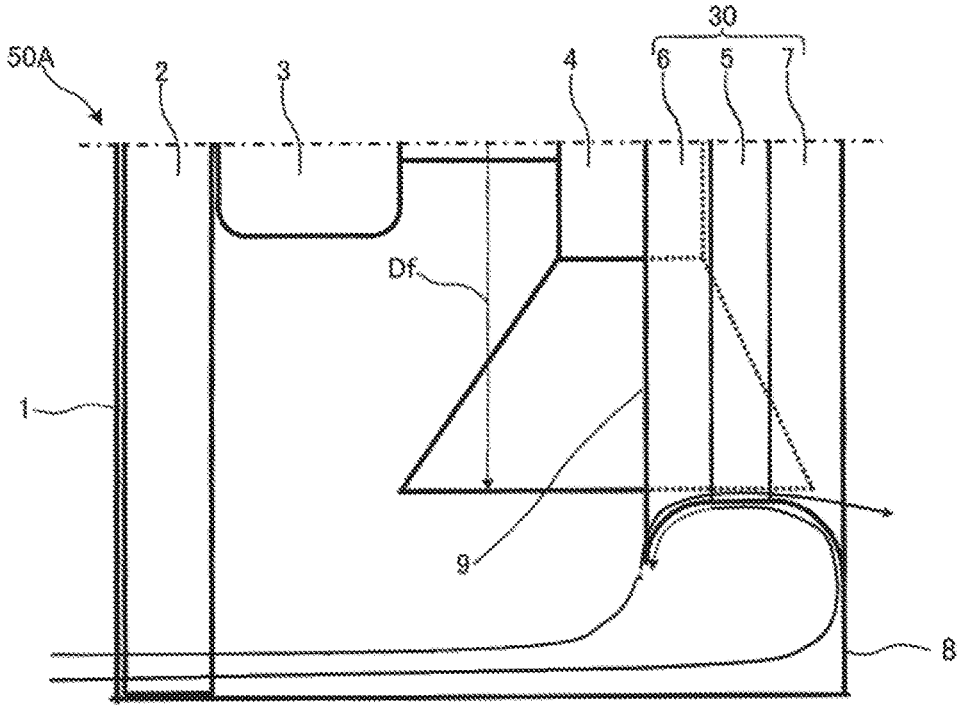
FIG. 3 is a schematic sectional view of the configuration example of the heat source unit according to Embodiment 1 of the present invention as viewed from the side.
Figure 4:
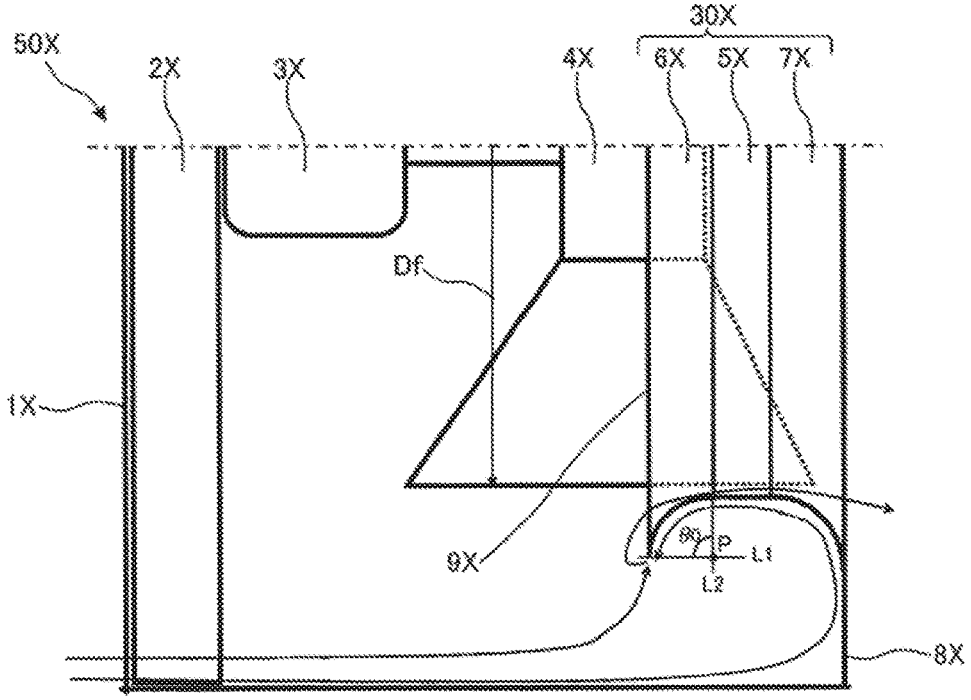
FIG. 4 Related Art
FIG. 4 is a schematic sectional view of a configuration example of a related-art heat source unit as viewed from a side.

FIG. 1 is a schematic sectional view of a configuration example of a heat source unit 50A according to Embodiment 1 of the present invention as viewed from a side. FIG. 2 is a schematic sectional view of the configuration example of the heat source unit 50A as viewed from a front side. FIG. 3 is a schematic sectional view of the configuration example of the heat source unit 50A as viewed from a side. FIG. 4 is a schematic sectional view of a configuration example of a related-art heat source unit 50X as viewed from a side. With reference to FIG. 1 to FIG. 3, the heat source unit 50A is described. In the following description, the heat source unit 50A is compared to the related-art heat source unit 50X illustrated in FIG. 4 as appropriate. The related-art heat source unit and components thereof are denoted by the reference symbols accompanied by the alphabet "X" so as to be distinguishable from heat source units according to embodiments of the present invention (the same applies to the embodiments described below).

<Configuration of Heat Source Unit 50A>

The heat source unit 50A is used as an outdoor unit as one configuration included in a refrigeration cycle apparatus such as an air-conditioning apparatus. Specifically, the heat source unit 50A is connected to a load-side unit (indoor unit; not shown) to construct a refrigeration cycle apparatus such as an air-conditioning apparatus. The air-conditioning apparatus as an example of the refrigeration cycle apparatus is described in Embodiment 5.

As illustrated in FIG. 1 to FIG. 3, the heat source unit 50A includes a casing 1, a heat exchanger 2, an axial-flow fan 4, a compressor (not shown), and other components. The casing 1 forms an outer shell. The heat exchanger 2 is installed inside the casing 1. The axial-flow fan 4 is installed inside the casing 1 and is configured to supply an air to the heat exchanger 2. The compressor is, for example, a compressor 101 described in Embodiment 5.

The casing 1 has air inlets formed in at least two surfaces (for example, a side surface and a rear surface) and is formed in a box shape. Further, a partition wall 11 illustrated in FIG. 2 is provided inside the casing 1 and defines an air-sending device chamber in which the axial-flow fan 4 is installed and a machine chamber in which the compressor and other components are installed.

The heat exchanger 2 is disposed at a position corresponding to the air inlets of the casing 1. For example, when the air inlet is formed in the side surface and the rear surface or the casing 1, the heat exchanger 2 may be formed to have an L-shape in top view so as to correspond to the air inlet formed in the side surface and the back surface of the casing 1.

A front panel 8 is provided on a front surface side of the casing 1 (on a side surface side of the heat exchanger illustrated in FIG. 2). An opening port through which the air flows is formed in the front panel 8.

The axial-flow fan 4 is driven to rotate by a fan motor 3 installed inside the casing 1. The fan motor 3 and the axial-flow fan 4 are coaxially coupled to each other.

Further, the axial-flow fan 4 is surrounded by a bellmouth 30. Specifically, the bellmouth 30 is provided so as to surround an outer periphery of the axial-flow fan 4.

The bellmouth 30 includes a straight tubular portion 5 having a cylindrical shape, an air inlet portion 6 having an arc-shaped cross section, and an air outlet portion 7 having an arc-shaped cross section. The air inlet portion 6 is on an upstream side of the straight tubular portion 5, and is radially expanded toward the upstream side. The air outlet portion 7 is on a downstream side of the straight tubular portion 5, and is radially expanded toward the downstream side. The straight tubular portion 5 has a cylindrical shape with a constant diameter and is positioned in the center in an axial direction of the bellmouth 30. The air inlet portion 6 is positioned on the upstream side of the straight tubular portion 5, specifically, closer to an air inlet of the bellmouth 30. The air outlet portion 7 is positioned on the downstream side of the straight tubular portion 5, specifically, closer to an air outlet of the bellmouth 30. The sectional shapes of the air inlet portion 6 and the air outlet portion 7 are not required to have perfect arc shapes.

The air inlet portion 6 will be described in detail.

As illustrated in FIG. 4, in sectional view of an air inlet portion 6X of the related-art heat source unit 50X, an angle formed by line L1 that is parallel to the axial direction of the air-flow fan 4 and passes a portion of an outer peripheral end portion of the air inlet portion 6X of the heat source unit 50X, which has a maximum diameter, and a line L2 that runs in a direction orthogonal to the axial direction of the axial-flow fan 4 and passes an end portion on a downstream side of the air inlet portion 6X (connected portion between the air inlet portion 6X and the straight tubular portion 5X) is taken as θ0. An intersection of the line L1 and the line L2 is taken as intersection P. The line L1, the line L2, and the intersection P are similarly defined for the heat source unit 50A.

Next, as illustrated in FIG. 1, in sectional view of the air inlet portion 6 of the heat source unit 50A, a straight line that connects a portion of an outer peripheral end portion of the air inlet portion 6 of the heat source unit 50A, which has a diameter smaller than a maximum diameter and larger than a minimum diameter, and the intersection P is taken as a straight line L3. An angle formed by the straight line L3 and the line L2 is taken as θi.

In this case, the air inlet portion 6 is formed so as to have at least one angle-reduced portion 10 that satisfies θ0>θi>0. The angle-reduced portion 10 is a portion which has an angle reduced to be smaller than the angle θ0 based on the angle θ0 as a reference and has a width in a circumferential direction of the bellmouth 30, as illustrated in FIG. 2. Specifically, in sectional view of the bellmouth 30 taken along a direction orthogonal to flow of the air at a position of the air inlet portion 6 as illustrated in FIG. 2, the angle-reduced portion 10 is formed so that a recessed portion is formed in at least a part of the air inlet portion 6. Further, in sectional view of the bellmouth 30 taken along a direction parallel to the flow of the air at a position of the angle-reduced portion 10 of the air inlet portion 6 as illustrated in FIG. 1, the air inlet portion 6 includes a portion having an arc-shaped cross section and a portion having a linear, i.e. straight-line, cross section.

<Operation and Effects of Heat Source Unit 50A>

After the heat source unit 50A starts operating, a controller (not shown) drives the fan motor 3 so that the axial-flow fan 4 is driven to rotate. By the rotation of the axial-flow fan 4, an air inlet flow is generated on the heat exchanger 2 side. Then, an air outside the heat source unit 50A is sucked into the heat source unit 50A. More specifically, the air outside the heat source unit 50A flows into the heat source unit 50A from the left side of a drawing sheet of FIG. 1. The farther from the axial-flow fan 4, the weaker the force of sucking the flow of the air into the axial-flow fan 4.

In the related-art heat source unit 50X, as illustrated in FIG. 4, the farther from the axial-flow fan 4X, the weaker the force of sucking the flow of the air into the axial-flow fan 4X. The air flowing into the heat source unit 50X collides with a back surface of a front panel 8X to directly flow along the back surface of the front panel 8X and flow along an outer wall of a bellmouth 30X.

Therefore, the air flowing into the heat source unit 50X is not guided from a heat exchanger 2X directly into the axial-flow fan 4X and collides with the back surface of the front panel 8X to concentrate on the back surface of the front panel 8X and the outer wall of the bellmouth 30X to increase an air velocity.

While being increased in air velocity, the flow of the air deviates in the end portion 9X on an upstream side of the air inlet portion 6X of the bellmouth 30X. The deviated flow of the air is directed to a side opposite to an axial center of the axial-flow fan 4X, specifically, becomes a backflow. Therefore, the flow, which is to be sucked into the axial-flow fan 4X to flow along the air inlet side of the bellmouth 30X, is pushed back by the backflow. As a result, an air volume is decreased. Further, the air does not flow along the air inlet side of the bellmouth 30X to generate release of the flow and become an airflow resistance.

An angle of the flow of the air at the time of deviation is determined by the angle θ0 of the air inlet portion 6X, and the air flows in a tangential direction of the end portion 9X on the upstream side of the air inlet portion 6X. For example, when θ0 is 90 degrees and an angle of the flow of the air is θv, the air deviates at 0 degrees. The angle θv becomes 0 degrees when the flow of the air is parallel to the front panel 8X.

In contrast, in the heat source unit 50A, the air inlet portion 6 has the angle-reduced portion 10 that satisfies θ0>θi>0. Therefore, as illustrated in FIG. 1, the flow of the air along the outer wall of the angle-reduced portion 10 has the angle θv of the flow larger than 0 degrees at the time of deviation and moves toward the axial-flow fan 4 to reduce a backflow component. Therefore, the release of the flow of the air, which occurs in the end portion 9 on the upstream side of the air inlet portion 6 of the bellmouth 30, can be suppressed.

Further, as illustrated in FIG. 3, the flow of the air in the vicinity of the angle-reduced portion 10 at the portion in which θ0 is achieved can be concentrated on the angle-reduced portion 10. Therefore, a velocity of the flow of the air flowing along the outer wall of the bellmouth 30 is reduced. Thus, the backflow of the air in the portion of the angle-reduced portion 10 in which θ0 is achieved can be suppressed. Therefore, the release of the air, which occurs in an end portion closer to the air inlet of the bellmouth 30 can be suppressed. Further, with the heat source unit 50A, the air inlet portion 6 has a simple shape and therefore can be formed integrally with the air outlet portion 7.

<Modification Example of Bellmouth 30>

Figure 5:
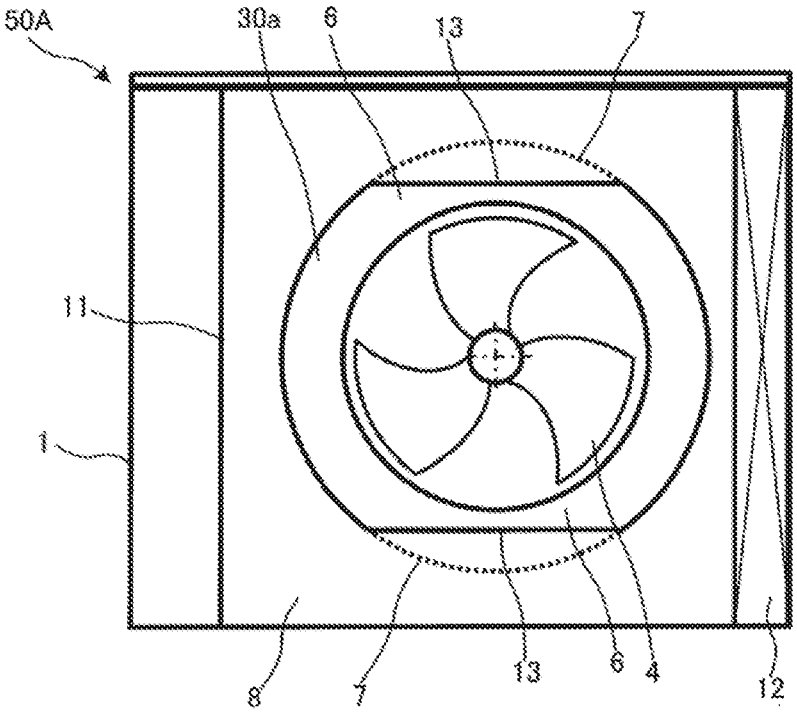
FIG. 5 is a schematic sectional view of another configuration example of the heat source unit according to Embodiment 1 of the present invention as viewed from a front side.

FIG. 5 is a schematic sectional view of another configuration example of the heat source unit 50A as viewed from a front side. With reference to FIG. 5, a modification example of the bellmouth 30 (hereinafter referred to as "bellmouth 30*a*") is described. The angle-reduced portion 10 included in the air inlet portion 6 of the bellmouth 30*a* is described as an angle-reduced portion 13 for the convenience of the description.

As illustrated in FIG. 5, each of the angle-reduced portions 13 may have such a shape that a range of the angle reduce portion 13 is linearly aligned with an end at a position at which the angle is most reduced. Specifically, in sectional view of the bellmouth 30*a* taken along a direction orthogonal to the flow of the air at a position of the air inlet portion 6 as illustrated in FIG. 5, the angle-reduced portions 13 are formed at two positions, specifically, on a top and a bottom of the bellmouth 30*a* so as to be linear in a horizontal direction. The above-mentioned effects are obtained by the shape. When the range is excessively large, however, a region in which the bellmouth 30*a* surrounds the axial-flow fan 4 is reduced to decrease pressure recovery achieved by the axial-flow fan 4. In addition, a force of pulling the flow along the outer wall of the portion having θ0 remains unchanged. Therefore, it is preferred that a plurality of the angular reduced portions 13 be provided instead of excessively increasing the range of formation of the angle-reduced portion 13.

Embodiment 2

Figure 6:
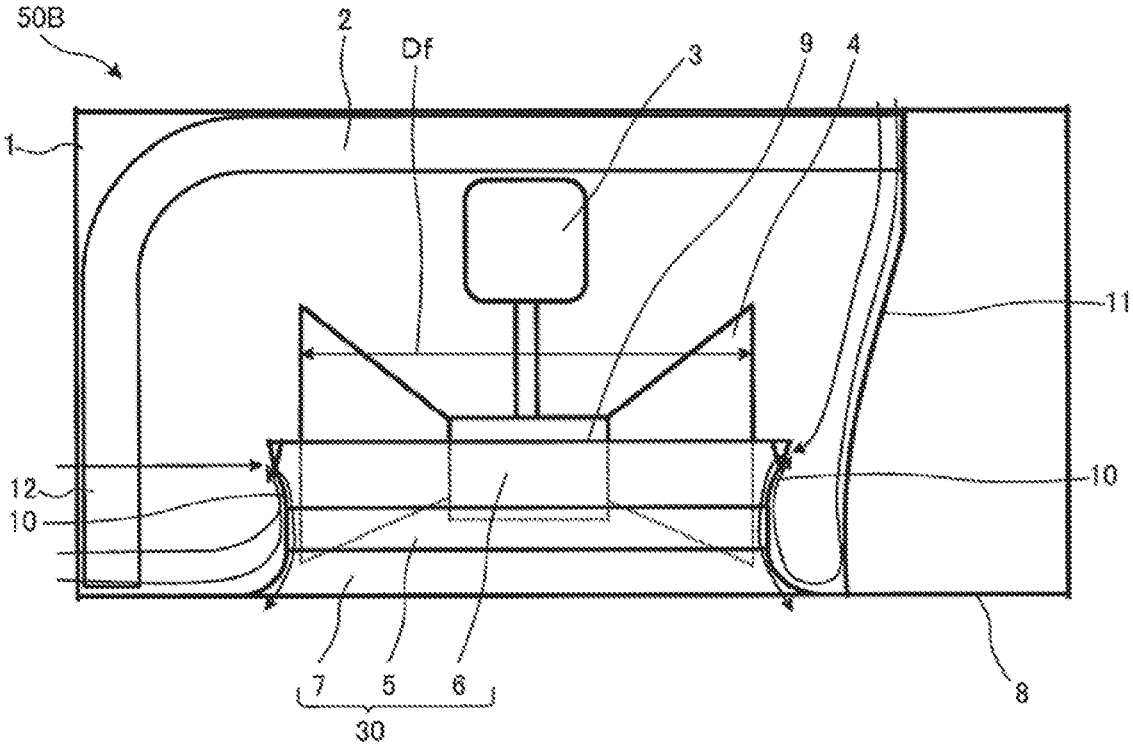
FIG. 6 is a schematic sectional view of a configuration example of a heat source unit according to Embodiment 2 of the present invention as viewed from a top.
Figure 7:
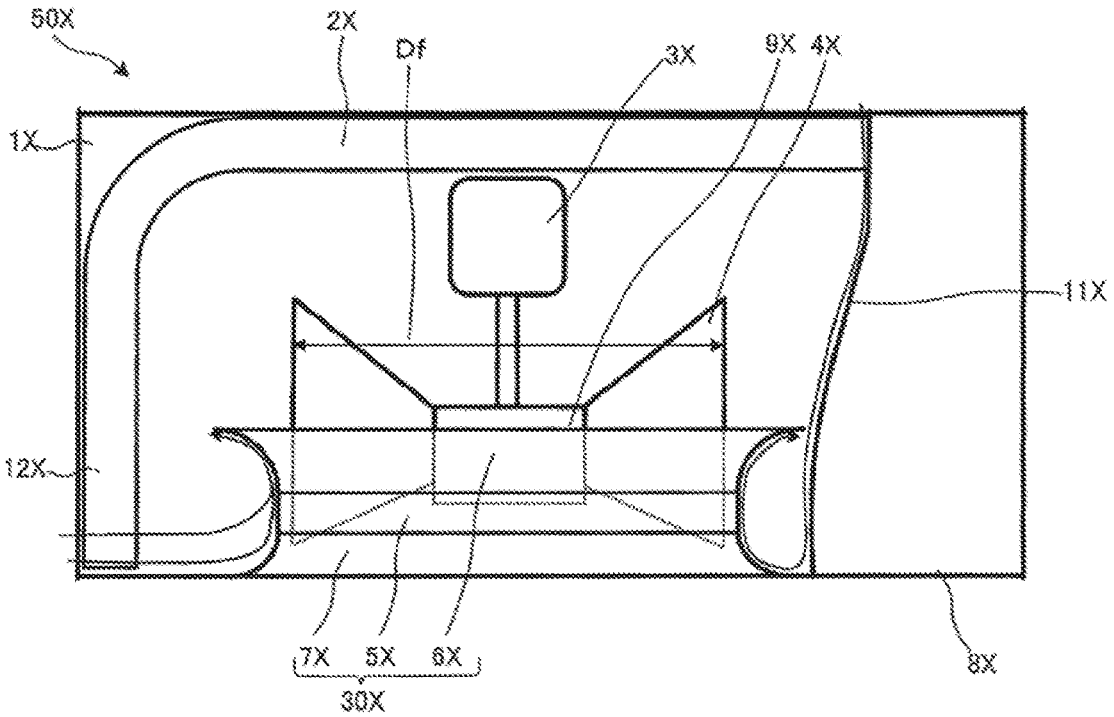
FIG. 7 Related Art
FIG. 7 is a schematic sectional view of the configuration example of the related-art heat source unit as viewed from a top.

FIG. 6 is a schematic sectional view of a configuration example of a heat source unit 50B according to Embodiment 2 of the present invention as viewed from a top. FIG. 7 is a schematic sectional view of a configuration example of the related-art heat source unit 50X as viewed from a top. With reference to FIG. 6, the heat source unit 50B is described. In the following description, the heat source unit 50B is compared to the related-art heat source unit 50X illustrated in FIG. 7 as appropriate. In Embodiment 2, differences from Embodiment 1 are mainly described. The same parts as those in Embodiment 1 are denoted by the same reference symbols, and the description thereof is omitted. The modification example applied to the same components as those of Embodiment 1 is similarly applied to Embodiment 2.

As illustrated in FIG. 6, the heat exchanger 2 is formed to have an L-shape in top view so as to be positioned in contact with the side surface and the rear surface of the casing 1. In the following description, a portion of the heat exchanger 2 positioned on the side surface of the casing 1 is referred to as "heat exchanger 12" for convenience of the description. Similarly, in the heat source unit 50X, the heat exchanger 2X positioned on a side surface of a casing 1X is referred to as "heat exchanger 12X".

In the heat source unit 50B according to Embodiment 2, the air inlet portion 6 of the bellmouth 30 is formed so that the angle-reduced portion 10 is positioned closer to the heat exchanger 12, or closer to the partition wall 11, or both.

Meanwhile, in the related-art heat source unit 50X, the flow of the air in the heat exchanger 12X, which is sucked from the vicinity of the front panel 8X, moves directly toward the outer wall of the bellmouth 30X as illustrated in FIG. 7. Therefore, a flow velocity along the outer wall of the bellmouth 30X is higher than a flow velocity at other positions. Further, in the related-art heat source unit 50X, the flow is concentrated on a wall surface of a partition wall 11X. Therefore, the flow velocity is higher at the partition wall 11X than the flow velocity at other positions.

In contrast, in the heat source unit 50B, the angle-reduced portion 10 is formed on the air inlet portion 6 of the bellmouth 30. Further, the angle-reduced portion 10 is positioned closer to the heat exchanger 12, or closer to the partition wall 11, or both. In this manner, as illustrated in FIG. 6, the effects obtained with the heat source unit 50A according to Embodiment 1 can be further enhanced in the heat source unit 50B.

Embodiment 3

Figure 8:
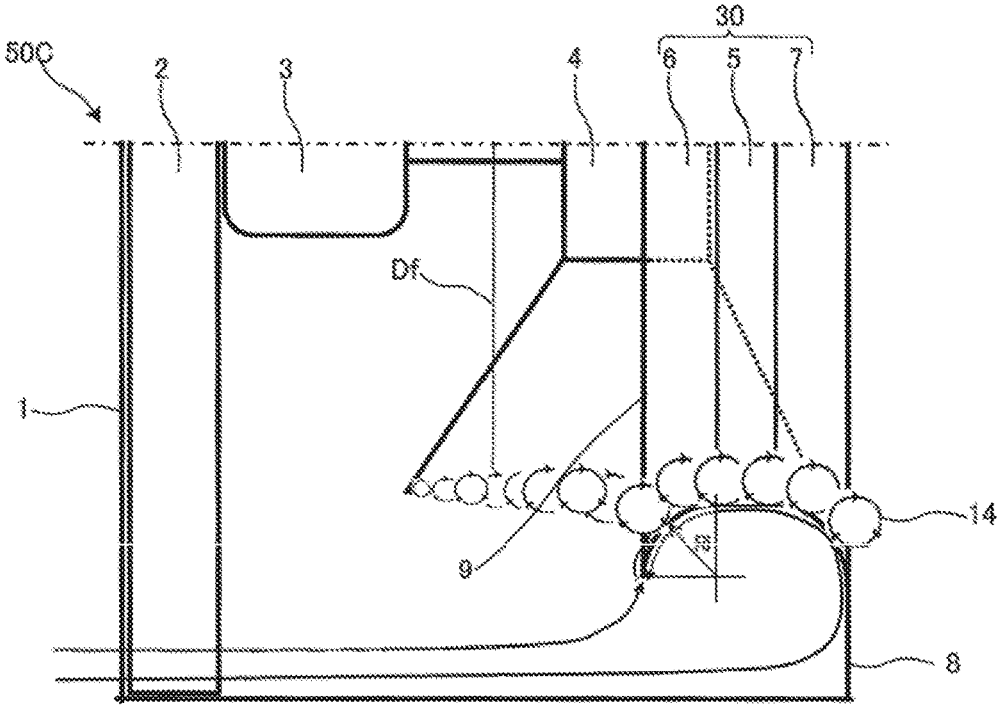
FIG. 8 is a schematic sectional view of a configuration example of a heat source unit according to Embodiment 3 of the present invention as viewed from a side.
Figure 9:
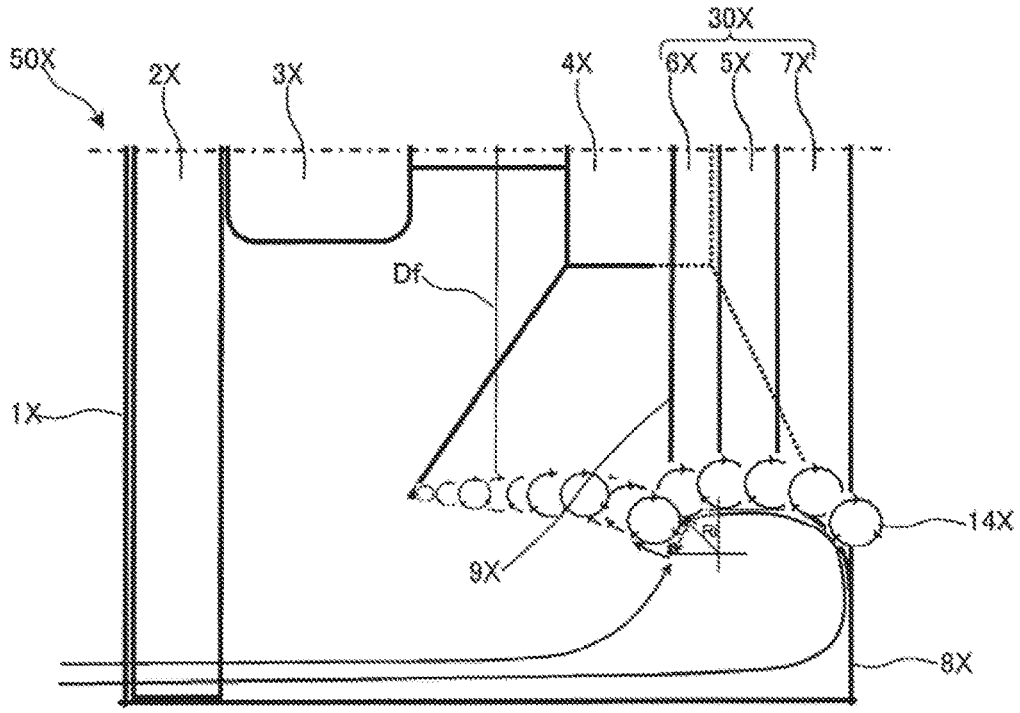
FIG. 9 Related Art
FIG. 9 is a schematic sectional view of the configuration example of the related-art heat source unit as viewed from a side.

FIG. 8 is a schematic sectional view of a configuration example of a heat source unit 50C according to Embodiment 3 of the present invention as viewed from a side. FIG. 9 is a schematic sectional view of a configuration example of the related-art heat source unit 50X on a side view. With reference to FIG. 8, the heat source unit 50C is described. In the following description, the heat source unit 50C is compared to the related-art heat source unit 50X illustrated in FIG. 9 as appropriate. In Embodiment 3, differences from Embodiment 1 and Embodiment 2 are mainly described. The same parts as those in Embodiment 1 and Embodiment 2 are denoted by the same reference symbols, and the description thereof is omitted. The modification example of the components as those of Embodiment 1 is also applied to Embodiment 3.

As illustrated in FIG. 8, in the bellmouth 30 of the heat source unit 50C according to Embodiment 3, when an outer diameter of the axial-flow fan 4 is taken as Df and a radius of the air inlet portion 6 is taken as Ri in sectional view of the bellmouth 30 taken along a direction parallel to the flow of the air at the position of the air inlet portion 6, the air inlet portion 6 is formed so as to satisfy Ri/Df>0.05.

As illustrated in FIG. 9, the axial-flow fan 4X of the related-art heat source unit 50X generates a backflow of the air, which is referred to as blade edge vortices (indicated by the arrows 14X in FIG. 9), due to a pressure difference between a positive pressure surface side and a negative pressure surface side of a blade. A dimension of each of the blade edge vortices generated by an axial-flow fan mounted in a general heat source unit (for example, the heat source unit 50X) is approximately 0.05 Df. The blade edge vortices generated on a blade surface are taken into the bellmouth under an influence of a viscosity and are released from the blade surface to flow to a downstream side while being in contact with the bellmouth.

In contrast, in the heat source unit 50C, the air inlet portion 6 of the bellmouth 30 is formed larger than the blade edge vortices (indicated by the arrows 14 in FIG. 8) by setting: Ri/Df>0.05 as illustrated in FIG. 8. In this manner, even in a region with which the blade edge vortices are in contact, the air can be made to flow along the end of the bellmouth 30 on the air inlet portion 6 side. Further, when the release of the air in the air inlet portion 6 of the bellmouth 30 is suppressed, the blade edge vortices can be forced to move toward the downstream side. Thus, an air volume is further increased to reduce noise.

Embodiment 4

Figure 10:
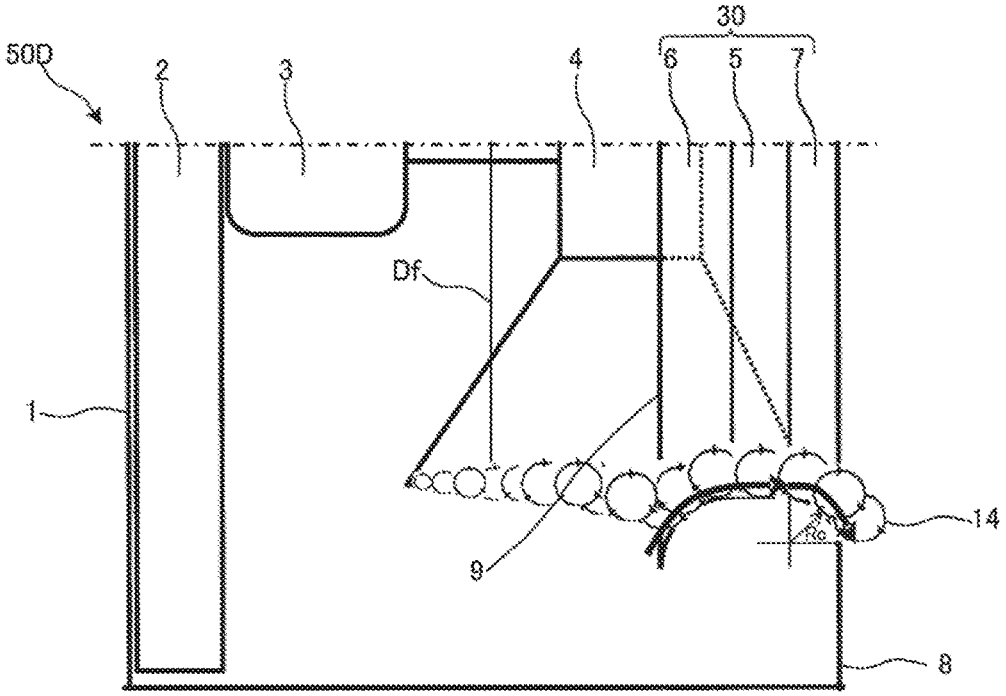
FIG. 10 is a schematic sectional view of a configuration example of a heat source unit according to Embodiment 4 of the present invention as viewed from a side.
Figure 11:
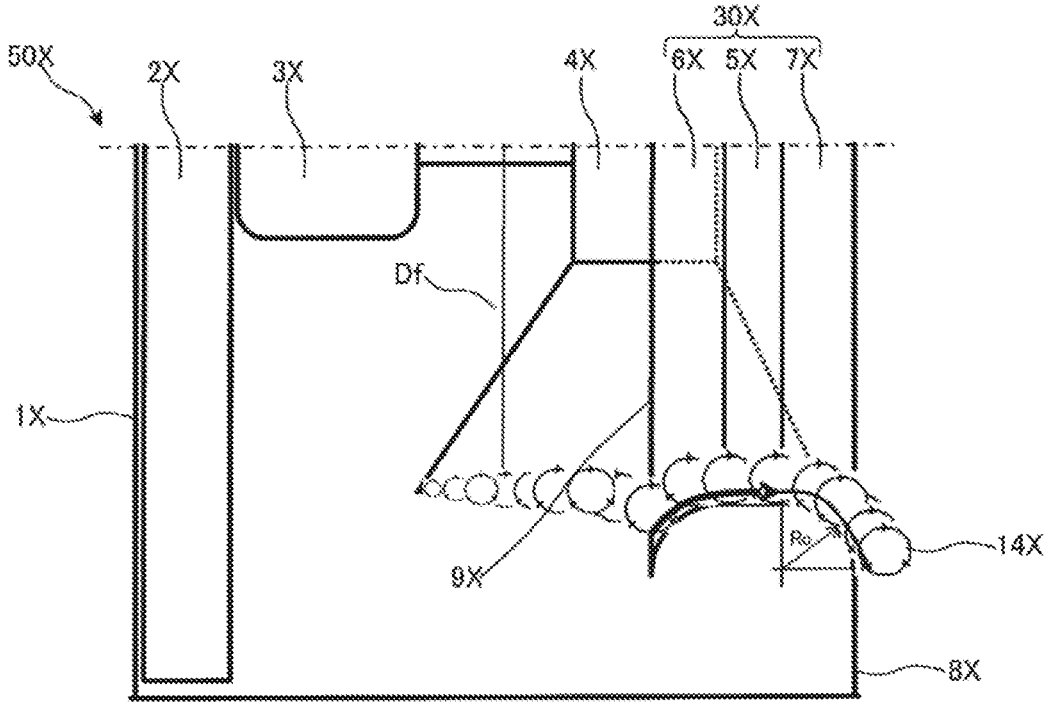
FIG. 11 Related Art
FIG. 11 is a schematic sectional view of the configuration example of the related-art heat source unit as viewed from a side.

FIG. 10 is a schematic sectional view of a configuration example of a heat source unit 50D according to Embodiment 4 of the present invention on a side view. FIG. 11 is a schematic sectional view of a configuration example of the related-art heat source unit 50X on a side view. With reference to FIG. 10, the heat source unit 50D is described. In the following description, the heat source unit 50D is compared to the related-art heat source unit 50X illustrated in FIG. 11 as appropriate. In Embodiment 4, differences from Embodiment 1 to Embodiment 3 are mainly described. The same parts as those in Embodiment 1 to Embodiment 3 are denoted by the same reference symbols, and the description thereof is omitted. The modification example applied to the same components as those of Embodiment 1 is similarly applied to Embodiment 4.

As illustrated in FIG. 10, in the bellmouth 30 of the heat source unit 50D according to Embodiment 4, in sectional view of the bellmouth 30 taken along a direction parallel to the flow of the air at the position of the air inlet portion 6, when an outer diameter of the axial-flow fan 4 is taken as Df and a radius of the air outlet portion 7 is taken R0, the air outlet portion 7 is formed so as to satisfy Ro/Df>0.05.

As described in Embodiment 3, the blade edge vortices (indicated by the arrows 14X in FIG. 11) flow to the downstream side while being in contact with the bellmouth to pass through the air outlet portion. The flow of the air spreads in the air outlet portion with the expansion of the air outlet portion. Therefore, the flow velocity becomes lower in a region outside of the straight tubular portion having the cylindrical shape. Therefore, when the configurations of Embodiment 1 to Embodiment 3 are adopted, the blade edge vortices can be pushed to the downstream side.

When the air outlet portion 7X satisfies Ro/Df>0.05 as illustrated in FIG. 11, however, the blade edge vortices flowing in the air outlet portion 7X move to the outside of the straight tubular portion 5X in which the flow velocity is slow. Thus, a pushing force is reduced.

In contrast, in the heat source unit 50D according to Embodiment 4, the air outlet portion 7 is formed so as to satisfy Ro/Df<0.05. Therefore, as illustrated in FIG. 10, the air outlet portion 7 can be formed smaller than the blade edge vortices (indicated by the arrows 14 illustrated in FIG. 10). Therefore, in Embodiment 4, the blade edge vortices do not move to the outside of the straight tubular portion 5 and can be pushed out in a region in which the flow velocity is high. Hence, in the heat source unit 50D, the air volume is further increased to achieve noise reduction.

Embodiment 5

Figure 12:
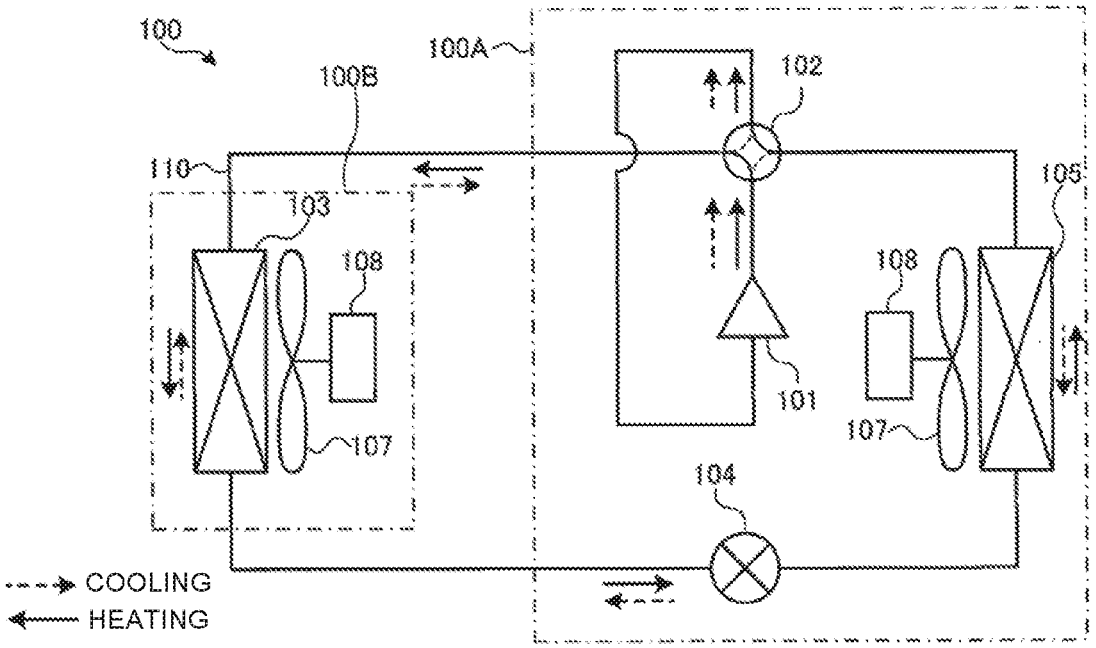
FIG. 12 is a circuit configuration diagram for schematically illustrating an example of a refrigerant circuit configuration of an air-conditioning apparatus according to Embodiment 5 of the present invention.

FIG. 12 is a circuit configuration diagram schematically illustrating an example of a refrigerant circuit configuration of an air-conditioning apparatus 100 according to Embodiment 5 of the present invention. With reference to FIG. 12, the air-conditioning apparatus 100 is described. In Embodiment 5, differences from Embodiment 1 to Embodiment 4 are mainly described. The same parts as those of Embodiment 1 to Embodiment 4 are denoted by the same reference symbols, and the description thereof is omitted. In FIG. 12, flow of refrigerant during a cooling operation is indicated by the broken arrows, whereas flow of the refrigerant during a heating operation is indicated by the solid arrows.

The air-conditioning apparatus 100 is an example of the refrigeration cycle apparatus, and includes an outdoor unit 100A and an indoor unit 100B.

The outdoor unit 100A accommodates the compressor 101, a flow switching device 102, an expansion device 104, a second heat exchanger 105, and an air-sending device 107 provided to the second heat exchanger 105. The air-conditioning apparatus 100 includes the heat source unit according to any one of Embodiment 1 to Embodiment 4 as the outdoor unit 100A.

The heat source unit 100B accommodates a first heat exchanger 103 and the air-sending device 107 provided to the first heat exchanger 103.

As illustrated in FIG. 12, the compressor 101, the first heat exchanger 103, the expansion device 104, and the second heat exchanger 105 are connected through refrigerant pipes 110 to form a refrigerant circuit. The air-sending devices 107 are provided to the first heat exchanger 103 and the second heat exchanger 105 to supply air to the first heat exchanger 103 and the second heat exchanger 105, respectively. The air-sending devices 107 are both rotated by air-sending device motors 108.

The compressor 101 is configured to compress the refrigerant. The refrigerant compressed by the compressor 101 is discharged to be sent to the first heat exchanger 103. The compressor 101 may be formed of, for example, a rotary compressor, a scroll compressor, a screw compressor, a reciprocating compressor, or other compressors.

The flow switching device 102 is configured to switch the flow of the refrigerant between the heating operation and the cooling operation. Specifically, the flow switching device 102 is switched so as to connect the compressor 101 and the first heat exchanger 103 during the heating operation and is switched so as to connect the compressor 101 and the second heat exchanger 105 during the cooling operation. The flow switching device 102 may preferably be formed of a four-way valve. A combination of two-way valves or three-way valves may be adopted as the flow switching device 102.

The first heat exchanger 103 functions as a condenser during the heating operation and functions as an evaporator during the cooling operation. Specifically, when functioning as the condenser, the first heat exchanger 103 exchanges heat between high-temperature and high-pressure refrigerant discharged from the compressor 101 and an air supplied by the air-sending device 107 to condense high-temperature and high-pressure gas refrigerant. Meanwhile, when functioning as the evaporator, the first heat exchanger 103 exchanges heat between low-temperature and low-pressure refrigerant flowing out of the expansion device 104 and the air supplied by the air-sending device 107 to evaporate low-temperature and low-pressure liquid refrigerant or two-phase refrigerant.

The expansion device 104 is configured to expand the refrigerant flowing out of the first heat exchanger 103 or the second heat exchanger 105 to decompress the refrigerant. The expansion device 104 may preferably be formed of, for example, an electric expansion valve capable of controlling a flow rate of the refrigerant, or other devices. As the expansion device 104, not only the electric expansion valve but also a mechanical expansion valve using a diaphragm for a pressure-receiving portion, a capillary tube, or other devices can be used.

The second heat exchanger 105 functions as an evaporator during the heating operation and functions as a condenser during the cooling operation. Specifically, when functioning as the evaporator, the second heat exchanger 105 exchanges heat between low-temperature and low-pressure refrigerant flowing out of the expansion device 104 and an air supplied by the air-sending device 107 to evaporate low-temperature and low-pressure liquid refrigerant or two-phase refrigerant. Meanwhile, when functioning as the condenser, the second heat exchanger 105 exchanges heat between high-temperature and high-pressure refrigerant discharged from the compressor 101 and the air supplied by the air-sending device 107 to condense high-temperature and high-pressure gas refrigerant.

The air-conditioning apparatus 100 includes the heat source unit according to any one of Embodiment 1 to Embodiment 4. Therefore, the second heat exchanger 105 corresponds to the heat exchanger 2 included in the heat source unit according to any one of Embodiment 1 to Embodiment 4. Similarly, the air-sending device 107 configured to supply the air to the second heat exchanger 105 corresponds to the axial-flow fan 4 included in the heat source units according to Embodiment 1 to Embodiment 4, and the air-sending device motor 108 corresponds to the fan motor 3 included in the heat source units according to Embodiment 1 to Embodiment 4.

<Operation of Air-Conditioning Apparatus 100>

An operation of the air-conditioning apparatus 100 is now described together with flow of the refrigerant. In this case, the operation of the air-conditioning apparatus 100 is described, taking as an example a case in which a heat exchanging fluid is an air and a heat exchanged fluid is refrigerant.

First, the cooling operation performed by the air-conditioning apparatus 100 is described. The flow of the refrigerant during the cooling operation is indicated by the broken arrows in FIG. 12.

As illustrated in FIG. 12, when the compressor 101 is driven, the refrigerant in a high-temperature and high-pressure gas state is discharged from the compressor 101. Then, the refrigerant flows in accordance with the broken arrows. The high-temperature and high-pressure gas refrigerant (single phase) discharged from the compressor 101 flows into the second heat exchanger 105 functioning as the condenser through the flow switching device 102. The second heat exchanger 105 exchanges heat between the high-temperature and high-pressure gas refrigerant flowing thereinto and the air supplied by the air-sending device 107 to condense the high-temperature and high-pressure gas refrigerant into high-pressure liquid refrigerant (single phase).

The high-pressure liquid refrigerant fed from the second heat exchanger 105 turns into refrigerant in a two-phase state, that is, gas refrigerant and liquid refrigerant at a low pressure, through the expansion device 104. The refrigerant in the two-phase state flows into the first heat exchanger 103 functioning as the evaporator. The first heat exchanger 103 exchanges heat between the refrigerant in the two-phase state flowing thereto and the air supplied by the air-sending device 107 to evaporate the liquid refrigerant contained in the refrigerant in the two-phase state into low-pressure gas refrigerant (single phase). The low-pressure gas refrigerant fed from the first heat exchanger 103 flows into the compressor 101 through the flow switching device 102 to be compressed into high-temperature and high-pressure gas refrigerant, which is then discharged from the compressor 101 again. Thereafter, the above-mentioned cycle is repeated.

Next, the heating operation performed by the air-conditioning apparatus 100 is described. The flow of the refrigerant during the heating operation is indicated by the solid arrows of FIG. 12.

As illustrated in FIG. 12, when the compressor 101 is driven, the refrigerant in a high-temperature and high-pressure gas state is discharged from the compressor 101. Then, the refrigerant flows in accordance with the solid arrows. The high-temperature and high-pressure gas refrigerant (single phase) discharged from the compressor 101 flows into the first heat exchanger 103 functioning as the condenser through the flow switching device 102. The first heat exchanger 103 exchanges heat between the high-temperature and high-pressure gas refrigerant flowing thereto and the air supplied by the air-sending device 107 to condense the high-temperature and high-pressure gas refrigerant into high-pressure liquid refrigerant (single phase).

The high-pressure liquid refrigerant fed from the first heat exchanger 103 turns into refrigerant in a two-phase state, that is, gas refrigerant and liquid refrigerant at a low pressure, through the expansion device 104. The refrigerant in the two-phase state flows into the second heat exchanger 105 functioning as the evaporator. The second heat exchanger 105 exchanges heat between the refrigerant in the two-phase state flowing thereto and the air supplied by the air-sending device 107 to evaporate the liquid refrigerant contained in the refrigerant in the two-phase state into low-pressure gas refrigerant (single phase). The low-pressure gas refrigerant fed from the second heat exchanger 105 flows into the compressor 101 through the flow switching device 102 to be compressed into high-temperature and high-pressure gas refrigerant, which is then discharged from the compressor 101 again. Thereafter, the above-mentioned cycle is repeated.

The refrigerant used in the air-conditioning apparatus 100 is not particularly limited. The effects can be exerted even when refrigerants such as 8410, R32, and HFO1234yf are used.

Although the air and the refrigerant are described as examples of a working fluid, the working fluid is not limited thereto. The same effects are exhibited even when other gases, other liquids, or gas-liquid mixture fluids are used. That is, although the working fluid varies, the effects are obtained.

For the air-conditioning apparatus 100, any refrigeration machine oil such as mineral oils, alkyl benzene oils, ester oils, ether oils, and fluorine oils can be used regardless of whether the oil is dissolvable or not in the refrigerant.

Other examples of the air-conditioning apparatus 100 include a water heater, a refrigerating machine, an air-conditioner water-heater combined system, and other apparatus. In any case, manufacture is easy, and heat exchange performance can be improved to improve energy efficiency.

As described above, the air-conditioning apparatus 100 includes the heat source unit according to any one of Embodiment 1 to Embodiment 5. Therefore, the air flowing into the heat source unit can be made to flow along the air inlet portion 6 of the bellmouth 30. Thus, the release of the air can be suppressed, and hence the noise is reduced. Further, according to the air-conditioning apparatus 100, the air inlet portion 6 has a simple shape and therefore can be formed integrally with the air outlet portion 7.

REFERENCE SIGNS LIST

1 casing 1X casing 2 heat exchanger 2X heat exchanger 3 fan motor 3X fan motor 4 axial-flow fan 4X axial-flow fan 5 straight tubular portion 5X straight tubular portion 6 air inlet portion 6X air inlet portion
7 air outlet portion 7X air outlet portion 8 front panel 8X front panel 9 upstream-side end portion 9X upstream-side end portion 10 angle-reduced portion 11 partition wall 11X partition wall 12 heat exchanger
12X heat exchanger 13 angle-reduced portion 14 blade edge vortex 14X blade edge vortex 30 bellmouth 30X bellmouth 30*a* bellmouth 50A heat source unit 50B heat source unit 50C heat source unit 50D heat source unit 50X heat source unit 100 air-conditioning apparatus 100A outdoor unit 100B indoor unit 101 compressor 102 flow switching device 103 first heat exchanger 104 expansion device
105 second heat exchanger 107 air-sending device 108 air-sending device motor 110 refrigerant pipe

The invention claimed is:

1. A heat source unit, comprising:

an axial-flow fan; and a bellmouth surrounding an outer periphery of the axial-flow fan, wherein the bellmouth includes:

a straight tubular portion having a cylindrical shape;

an air inlet portion, which is positioned on an upstream side of the straight tubular portion, and is radially expanded toward the upstream side; and an air outlet portion, which is positioned on a downstream side of the straight tubular portion, and is radially expanded toward the downstream side, and wherein, in sectional view of the air inlet portion of the bellmouth taken along a direction parallel to flow of an air, the air inlet portion has at least one angle-reduced portion that satisfies $\theta 0>0i>0$, where, an angle formed by a line L1 and a line L2 is taken as $\theta 0$, and an angle formed by a straight line L3 and the line L2 is taken as $\theta i$, the line L1 is a line passing through a portion of an outer peripheral end portion of the air inlet portion, which has a maximum diameter, and running in parallel to an axial direction of the axial-flow fan, the line L2 is a line passing through a connecting portion between the air inlet portion and the straight tubular portion and running in a direction orthogonal to the axial direction of the axial-flow fan, and the straight line L3 is a line connecting an intersection P of the line L1 and the line L2 and a portion of the outer peripheral end portion of the air inlet portion, which has a diameter smaller than the maximum diameter and larger than a minimum diameter and the angle-reduced portion is formed to be linear in sectional view of the inlet portion of the bellmouth in a direction orthogonal to the flow of the air.

2. The heat source unit of claim 1, wherein the angle-reduced portion is formed to be linear at top and down positions of the bellmouth in a horizontal direction.

3. The heat source unit of claim 1, further comprising:

a casing having air inlets formed in at least two surfaces; and a heat exchanger disposed inside the casing at a position corresponding to the air inlets, wherein the casing has one of the air inlets formed in a side surface and is partitioned by a partition wall into an air-sending device chamber and a machine chamber, and wherein the air inlet portion has the angle-reduced portion arranged so as to be positioned on at least one of a position closer to the heat exchanger to be positioned on the side surface and a position closer to the partition wall.

4. The heat source unit of claim 1, wherein, in sectional view of the air inlet portion of the bellmouth taken along a direction parallel to the flow of the air, when an outer diameter of the axial-flow fan is taken as Df and a radius of the air inlet portion is taken as Ri, the air inlet portion is formed so as to satisfy $Ri/Df>0.05$.

5. The heat source unit of claim 1, wherein, in sectional view of the air inlet portion of the bellmouth taken along the direction parallel to the flow of the air, when the outer diameter of the axial-flow fan is taken as Df and a radius of the air outlet portion is taken as R0, the air inlet portion is formed so as to satisfy $Ro/Df>0.05$.

6. A refrigeration cycle apparatus, comprising:

the heat source unit of claim 1; and a load-side unit to be connected to the heat source unit.

* * * * *